US005924241A

United States Patent [19]

Hodge

[11] Patent Number: 5,924,241

[45] Date of Patent: Jul. 20, 1999

[54] DECORATIVE COVER FOR PLANT POT

[76] Inventor: Jana Hodge, 22800 SW. 207 Ave., Miami, Fla. 33170

[21] Appl. No.: 08/880,768

[22] Filed: Jun. 23, 1997

[51] Int. Cl.[6] ..... A01G 9/02

[52] U.S. Cl. ..... 47/72

[58] Field of Search ..... 47/72, 65.5

[56] References Cited

U.S. PATENT DOCUMENTS

| | | | |
|---|---|---|---|
| 716,668 | 12/1902 | Cheney | 47/72 |
| 1,446,563 | 2/1923 | Hughes | 47/72 |
| 1,697,751 | 1/1929 | Blake | 47/72 |
| 1,868,853 | 7/1932 | Sievers | 47/72 |
| 2,209,778 | 7/1940 | Krasowski | 47/72 |
| 2,302,259 | 11/1942 | Rothfuss | 47/72 |
| 5,318,821 | 6/1994 | Bradley, Jr. | 47/72 |

FOREIGN PATENT DOCUMENTS

| | | | |
|---|---|---|---|
| 1084888 | 7/1954 | France | 47/72 |

*Primary Examiner*—Michael J. Carone
*Assistant Examiner*—Joanne C. Downs
*Attorney, Agent, or Firm*—Foley & Lardner

[57] ABSTRACT

A decorative cover for plant pots including a body adapted to extend around a pot, an elastic band adjacent the bottom of the cover adapted to resiliently engage the pot, and a further elastic band near the top of the cover to provide vertical stability to the cover.

7 Claims, 2 Drawing Sheets

DECORATIVE COVER FOR PLANT POT

BACKGROUND OF THE INVENTION

The present invention relates as indicated to a decorative cover for a plant pot, and relates more particularly to a novel cover which can be constructed of various sizes to accommodate widely varying pot diameters ranging from so-called mini-pots approximately 1 inch in diameter to pot diameters up to 2 feet or more.

Decorative covers for flower pots are well-known in the art and comprise various shapes and forms. Although the following list is not intended to be exhaustive, typical flower pot covers and methods of making the same are disclosed in U.S. Pat. Nos. 1,868,853; 2,159,302; 2,171,835; 5,293,715; 5,551,140; and 5,577,345. The present invention constitutes an improvement over the pot covers disclosed in the patents referred to.

SUMMARY OF THE INVENTION

A principal feature of the invention is the ability to accommodate essentially all sizes of pots, from as small as 1 inch up to 2 or more feet. This is possible because the basic concepts of the invention are applicable regardless of pot size. The cover is resiliently constricted at its bottom open end so as to resiliently engage the sidewall of the pot at its bottom, and is provided with a further resiliently constricted area adjacent the lip or rim of the pot. As a result, the cover retains its vertical shape when positioned around the pot, even though the areas of the cover other than the constricted areas may be loosely spaced from the outer surface of the pot thus accenting the shape of the decorative cover.

A further feature of the invention is the versatility it provides. It can not only be made in widely varying sizes as above noted, but also from an endless array of fabrics and colors. This permits the individual style and taste of the user to be accommodated. The fabric used is preferably machine washable and dryable so that the cover can be periodically removed for cleaning.

The versatility is further expressed in the ability of a single cover to be used with a fairly wide range of pot sizes. Due to the resiliently constricted area at the bottom of the cover, a single cover is capable of resiliently yet firmly engaging the outer surface of pots, ranging, for example, from 6 inches up to 8–9 inches in diameter. To accomplish this, the bottom of the cover includes an elastic band which enables the cover to firmly engage the pot near its bottom. The elastic band can be resiliently expanded to fit a wide range of pots, thereby providing substantial flexibility. This is important in view of the wide variety of pot sizes and shapes, and is contrasted with many prior art decorative covers which are specifically sized to fit around a particular pot size.

A further feature of the invention is that the decorative cover is preferably open at both the bottom and top thereof, whereby the cover does not interfere with proper cultural procedures for the plant. For example, normal watering practices can be followed since the drainage holes in the bottom of the pot remain exposed.

A still further feature of the invention is the outwardly flared collar at the top of the decorative cover. This provides a very elegant appearance and also serves to hide the upper lip of the pot.

The cover can either be of closed, cylindrical shape, or a single piece which can be wrapped around the pot and the opposite ends secured together. This wrap-around embodiment can be used with pots of all sizes and is particularly useful for large diameter pots. Although the opposed ends can be removably connected in any suitable manner, the use of velcro strips has proved very satisfactory. The wrap-around covers are similarly resiliently constricted both at their bottoms to firmly engage the pot and also in their upper regions to maintain vertical integrity of the cover.

The decorative cover can be aesthetically enhanced by accessories such as a bow which can be removably attached to the cover to provide additional decorative effect.

When the decorative cover is not in use, it can simply be folded and put away. Several covers of different sizes, patterns and colors can be alternately used to provide an aesthetic fit with a particular decor, or to simply permit colors to be periodically changed. The wide choice of fabrics and textiles provides a literally endless potential for decorative effect.

The decorative cover according to one embodiment of the present invention can be generally described as comprising a closed cylindrical body of fabric material adapted to extend around the entire pot and vertically above the top rim of the pot, elastic means for resiliently constricting the bottom of the cover so that it resiliently tightly engages the sidewall of the pot near its bottom, and further elastic means spaced upwardly on the cover providing a second constriction area to provide vertical stability to the cover.

The invention can be further described by reference to an alternative embodiment in which the cover is a flat fabric piece which can be wrapped around the pot, with the adjoining edges of the cover when so wrapped being provided with connecting strips which can be secured together to form the annular cover. This embodiment can be installed around the pot without moving or lifting the pot. This is particularly important for pots of larger diameters, but the wrap-around embodiment is used for pots of all diameters.

These and other objects of the invention will become more apparent as the following description proceeds with particular reference to the application drawings.

BRIEF DESCRIPTION OF THE DRAWINGS

In the application drawings.

DETAILED DESCRIPTION OF THE PREFERRED EMBODIMENTS

Figure 2:
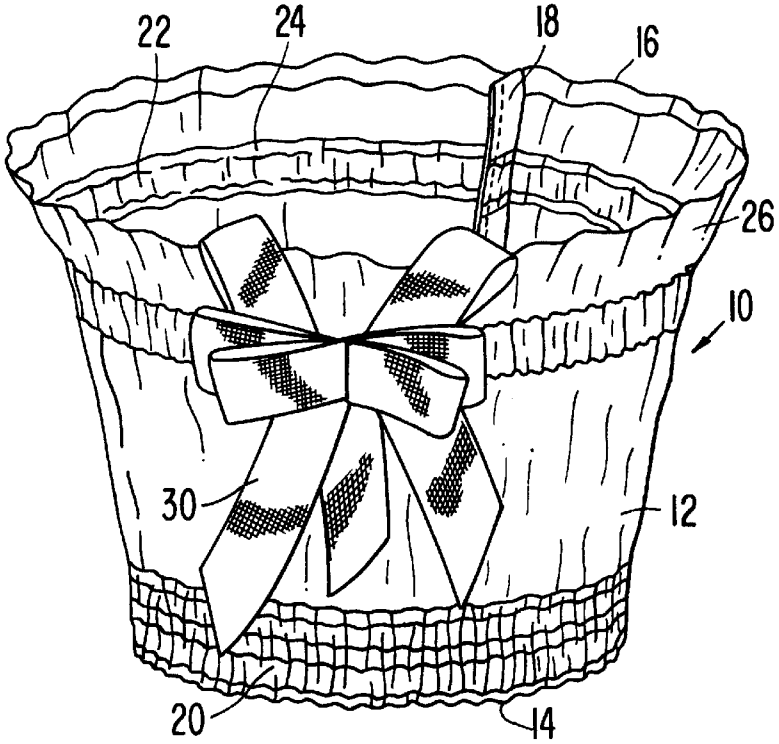
FIG. 2 is a top perspective view of the cover of FIG. 1, shown by itself.
Figure 1:
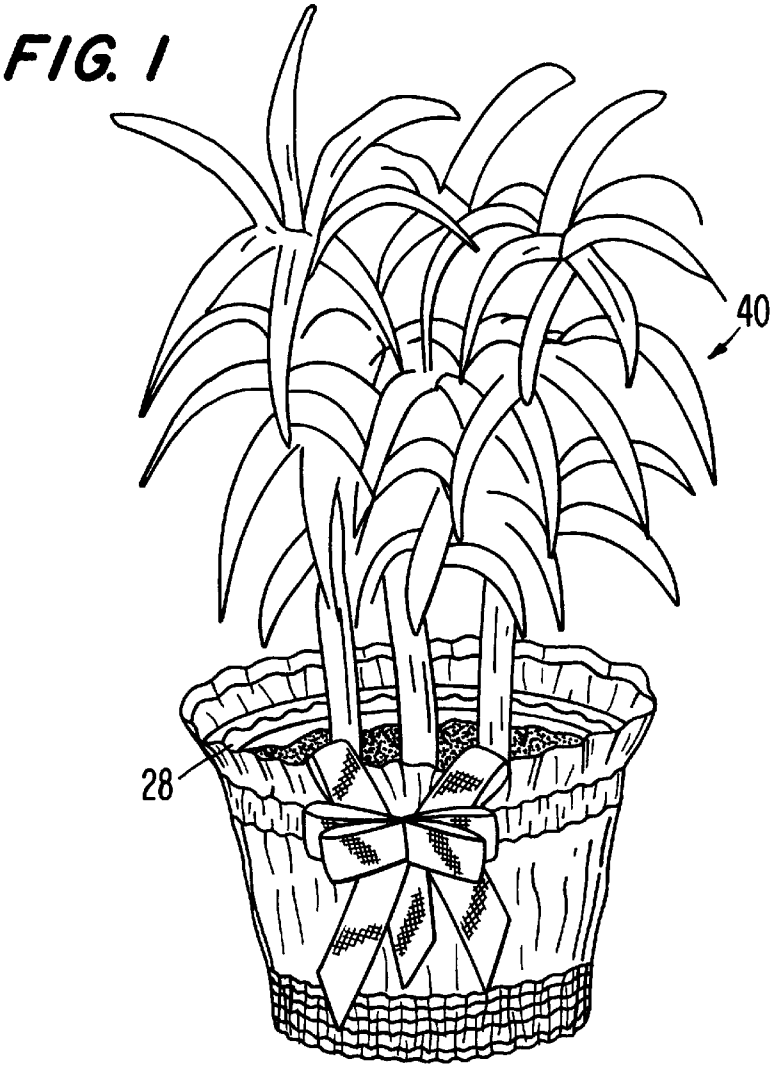
FIG. 1 is a top perspective view showing one form of decorative cover of the present invention, positioned around a potted plant.

Referring to the embodiment illustrated in FIGS. 1 and 2, the pot cover is generally indicated at 10 and comprises a body 12 formed from any desired material in single layer, double layer or laminated construction. The cover is preferably formed from a machine washable and dryable fabric of any desired type. The color of the cover, and print pattern, if any, can be selected to accommodate the tastes and/or decor of the user.

The cover is annular and open at the bottom end 14 and top end 16. The cover is preferably formed by stitching (as shown at 18) the ends of a piece of fabric material to form a continuous closed cylinder.

An elastic band 20 is attached to the interior edge of the fabric at a location which comprises the bottom of the cover, with the elastic band preferably being secured to the inside of the cover by stitching, in a manner which per se forms no part of the present invention. The elastic band 20 per se is well known in the art and is commonly used in stretchable clothing, for gathering pleats in various uses of fabrics, etc. The band comes in various widths, and includes resiliently expansible strands of elastic material which constricts the fabric in the area of the fabric to which the elastic band is secured, all in a well known manner. The band 20 can be exposed on the interior of the cover, or encased or enclosed in a manner to be presently described with respect to an upper elastic band.

A second elastic band 22 is located nearer the top of the cover, with the elastic band 22 being positioned in an annular pocket formed by the main body 12 of the cover and a separate fabric strip 24 located on the inside surface of the cover, as shown in FIG. 2. The band 22 may be the same or different in width compared to band 20. The fabric strip 24 fully covers the elastic band 22 so that the band is not visible, with the fabric strip 24 being affixed to the material of the main body 12 by stitching or the like. If the fabric is of double layer construction, both the upper band 22 and lower band 20 can be retained in position by stitching the layers above and below each band. The double layer provides a more finished look, and the outer and inner layers can if desired be of different colors or fabrics.

The elastic band 22 is preferably somewhat longer and consequently less constrictive than the band 20. The band 22 serves to gather the cover in the upper region thereof thus producing an outwardly flared collar 26 which forms the top of the cover and which hides the upper lip of the pot. At the same time, the elastic band 22 provides vertical integrity and stability to the cover when mounted around the pot thereby preventing the upper portions of the cover from sagging.

If the pot has a height at least equal to the distance between the bands 20 and 22, the band 22 will also resiliently engage the adjacent outer surface of the pot to provide an additional engagement area. This further stabilizes the cover when mounted around the pot. If the top of the pot terminates below the region of the upper elastic band 22, the band nevertheless gathers constrictively to maintain the vertical integrity of the cover. In either event, the stand up collar 26 extends upright and outwardly flared thereby to provide an attractive top to the cover while at the same time hiding from view the top lip of the pot, shown at 28 in FIG. 1.

The decorative value of the pot cover can be further enhanced by the use of additional decorative accessories such as, for example, bow 30. The style and color of the bow can be selected to match the color of the cover, and the bow is removably attachable to the cover. This permits quick removal of the bow in the event it is desired to clean the cover, and also affords interchangeability of the bow with others of different form and/or color. This permits a high degree of individuality to be achieved.

An advantage of the pot cover of the present invention is its open bottom. As a result, the cover does not interfere with the bottom drainage holes in the pot, and therefore does not interfere with preferred watering procedures for the plant.

When the cover is not in use, it can be folded and stored. To use the cover, the pot can be dropped into the cover until the bottom of the pot is laterally adjacent the elastic band 20, or the cover can be slipped over and around the pot and lowered into position. When so positioned, the band 20 is expanded so that the band firmly and resiliently engages the outer surface of the pot. If the height of the pot exceeds the height of the elastic band 22, the elastic band 22 will likewise be expanded when the pot is positioned within the cover, and the band 22 will firmly and resiliently engage the pot near the top thereof. The engagement of the pot by the cover at two vertically spaced locations serves to more securely maintain the cover around the pot. In such position, the main body 12 of the cover fits loosely around the pot and the collar 26 stands upright and outwardly flared. The constrictive engagement provided by the bands 20 and 22 maintains the cover in such position.

An important advantage of the present invention is the flexibility of the cover with respect to pot sizes. The ability of the elastic bands to expand permits a wide range of pot sizes to be accommodated by the same cover. This range is essentially controlled by the size and effective resilient expansion of the elastic bands, and the pleating of the fabric material to accommodate varying degrees of expansion. The smallest pot size accommodated by a particular size cover is dictated by the size of the cover at the bottom end thereof when the elastic is fully relaxed. The accommodation of larger pot sizes is limited by the expansibility of the bands 20 and 22 and sufficient material pleating.

The form of the invention shown in FIGS. 1 and 2 is particularly adaptable to pots in the small to medium range. By varying the size of the cover, pot covers can be made to accommodate pots as little as one inch in diameter up to pots well in excess of one foot in diameter. In that latter range and for pots even larger, the positioning of the pot cover around the pot becomes more of a problem. For larger pots, the embodiment of the invention illustrated in FIG. 3 is preferred.

Figure 3:
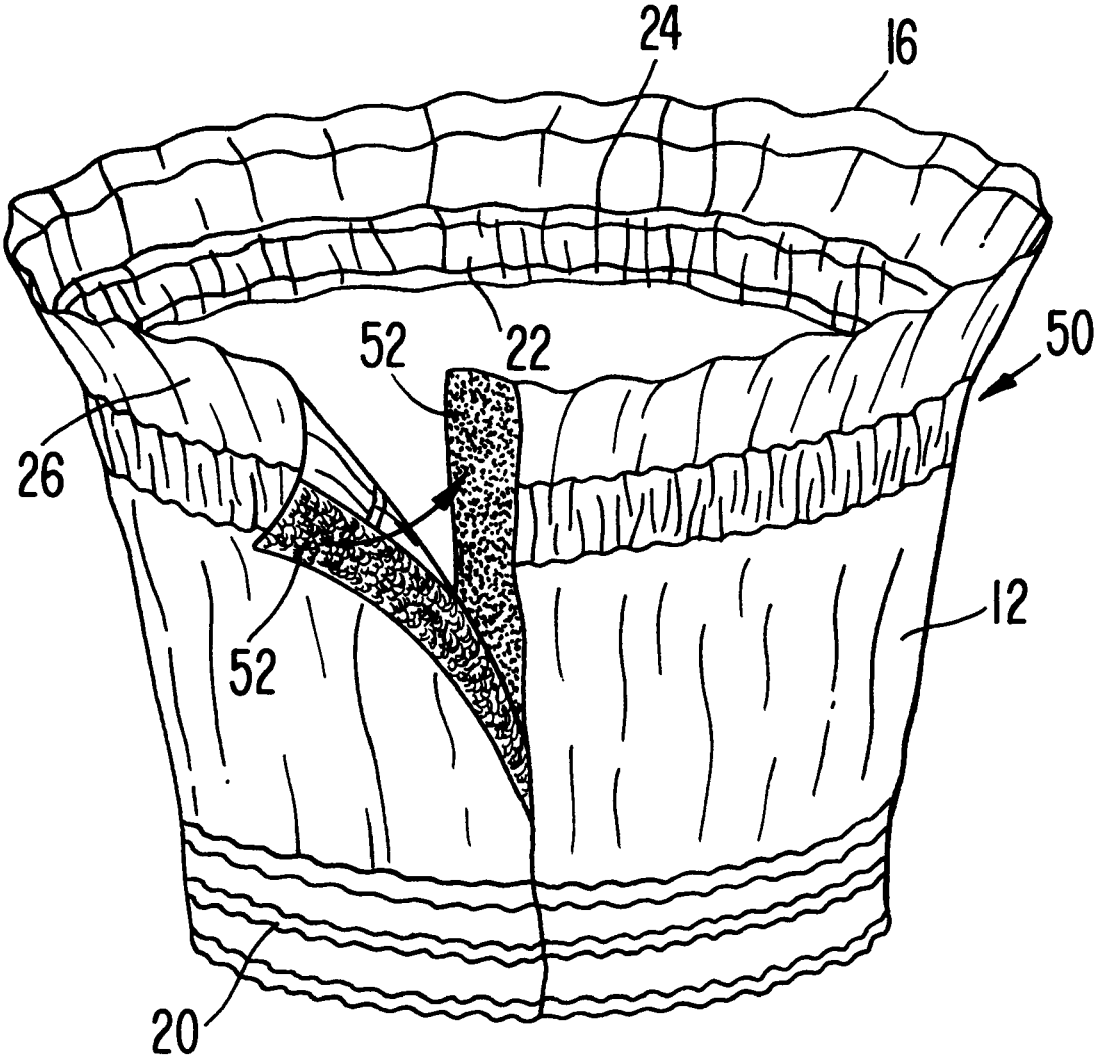
FIG. 3 is a fragmentary top perspective view showing an embodiment of the invention in which the cover can be wrapped around the pot and secured at adjoining ends for enclosing the pot.

In FIG. 3, features of the invention previously described and illustrated are represented by the same reference numerals. The cover in FIG. 3 is generally indicated at 50, and in lieu of the seamed connection 18 illustrated in FIG. 2, the fabric material has opposed free ends. At each end, a strip of Velcro material commonly designated at 52 is secured to each edge, preferably along the entire width thereof. The strip is applied along the outer edge of one end and along the inner edge of the opposed end whereby when the ends are overlapped as shown in FIG. 3, the Velcro strips will be facing each other for fastening, thus completing the cover.

In use, the cover is simply wrapped around the pot and the ends of the fabric secured. This permits the cover to be put in place regardless of the size of the pot. Once in place, the elastic bands 20 and 22 function as previously described to resiliently engage the adjoining areas on the outer surface of the pot, thereby maintaining vertical integrity of the cover. The cover in this form is also open ended so that the cover does not interfere with preferred culturing of the potted plant.

To remove the cover 50 for cleaning or replacement, the Velcro fasteners 52 are simply disconnected and the cover removed from around the pot. It will thus be seen that the FIG. 3 form of the invention provides all of the described features and advantages of the cover of FIGS. 1 and 2 while at the same time permitting the cover to be put in place without lifting or moving the pot. This is a desirable feature regardless of pot size, but is particularly desirable for large and heavy pots.

In the FIG. 3 embodiment, it will be apparent that the adjoining ends of the fabric can be secured together by means other than the Velcro strips illustrated. For example, snap or hook fasteners could be used, or any other suitable fastening means which will retain the adjoining ends of the cover secured but permitting quick and easy separation of the ends when it is desired to remove the cover for replacement or cleaning.

Although the covers illustrated in FIGS. 1–3 are ideally suited for pot diameters of approximately 6" or larger, the covers can be made proportionately smaller to fit pots of essentially any size. Regardless of size, the covers maintain their essential characteristics, namely a bottom which resiliently engages the pot to retain the cover in place, a second resiliently constrictive area near the top of the cover, and an outwardly flared collar at the top for decorative effect and also to hide the top of the pot but not the plant. The constricted areas serve to maintain the vertical dimension of the cover and prevent sagging or drooping of the cover. Those basic characteristics are common to all covers regardless of size, and regardless of whether the cover is of the closed, FIGS. 1–2 form or FIG. 3 form in which the cover is wrapped around the pot and the ends of the covers secured.

Changes may be made in the materials and construction of the described embodiments without departing from the spirit and scope of the invention as defined in the claims appended hereto.

What is claimed is:

1. A decorative cover for covering the outer surface of a plant pot having a generally cylindrical side-wall extending axially from a bottom end to a top rim, the decorative cover comprising:

a body of fabric material adapted for covering an outer surface of the generally cylindrical side-wall, the body of fabric material extending circumferentially from a first end to a second end and extending axially from a lower edge adapted for placing adjacent the bottom end to an upper edge adapted for projecting beyond the top rim, the first and second ends being substantially free ends when the cover is not in use;

a first elastic member being secured to the cover proximal to the lower edge and resiliently constricting the cover, the first elastic member being adapted for contiguously engaging the bottom end;

a second elastic member being secured to the cover proximal to the upper edge and resiliently constricting the cover, the second elastic member being adapted for contiguously engaging the top rim; and VELCRO strips respectively secured to the first and second ends of the cover, the VELCRO strips being engaged when the cover is wrapped around the pot to form an annular cover;

wherein the first elastic member is shorter than the second elastic member; and wherein the cover construction includes double layers having the first and second elastic members positioned between the layers and retained in place by stitching the body of fabric material above and below each of the first and second elastic members.

2. The decorative cover of claim 1, wherein a portion of the body above the second elastic member is flared outwardly to provide an upstanding collar adapted for hiding the top rim.

3. The cover of claim 1 wherein the cover is continuous and circular in cross-section.

4. The decorative cover of claim 1, wherein the first and second elastic members comprise elastic bands positioned in areas of the body that are adapted for resiliently engaging the pot, the fabric material in such areas being pleated and gathered.

5. The decorative cover of claim 1, further including a bow removably connected to the body to enhance the aesthetic effect.

6. The decorative cover of claim 1, wherein the first and second elastic members have the same width.

7. A decorative cover for covering an outer surface of a plant pot having a generally cylindrical side-wall extending axially from a bottom end to a top rim, the decorative cover comprising:

a body of laminated fabric material having sufficient length to be pleated and adapted to extend circumferentially around the pot;

a first elastic band secured to the body of the cover and adapted to be proximal to the bottom of the pot and adapted to resiliently and firmly engage the pot, the first elastic band being positioned between layers of the laminated fabric material and secured by stitching above and below the first elastic band;

a second elastic band spaced from the first elastic band and resiliently constricting the body of the cover, the second elastic band being adapted to be proximal to the top rim of the pot and positioned between layers of the laminated fabric material and secured by stitching above and below the second elastic band, the second elastic band being longer than the first elastic band; and an upwardly and outwardly flared collar of the cover adapted to extend above and consequently hide the top rim of the pot;

wherein the body has circumferential ends adapted to be separate and substantially free when the cover is not in use, and VELCRO strips secured to the circumferential ends, the VELCRO strips being engaged with one another so as to form an annular cover.

* * * * *